US007819344B2

(12) United States Patent
Abe et al.

(10) Patent No.: US 7,819,344 B2
(45) Date of Patent: Oct. 26, 2010

(54) ELECTRO-MAGNETO FUEL INJECTOR

(75) Inventors: Motoyuki Abe, Hitachinaka (JP); Masahiko Hayatani, Hitachinaka (JP); Atsushi Sekine, Hitachinaka (JP); Yasuo Namaizawa, Hitachinaka (JP); Tohru Ishikawa, Kitaibaraki (JP); Noriyuki Maekawa, Kashiwa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/654,528

(22) Filed: Jan. 18, 2007

(65) Prior Publication Data

US 2007/0194152 A1 Aug. 23, 2007

(30) Foreign Application Priority Data

Feb. 17, 2006 (JP) ..... 2006-040929

(51) Int. Cl.

| | |
|---|---|
| ***F02M 51/06*** | (2006.01) |
| ***F02M 51/00*** | (2006.01) |
| ***F02M 59/20*** | (2006.01) |
| ***F02M 61/20*** | (2006.01) |
| ***F02M 61/16*** | (2006.01) |

(52) U.S. Cl. ..... 239/585.2; 239/585.1; 239/533.6; 239/533.9

(58) Field of Classification Search ..... 239/585.2, 239/533.2, 533.6, 533.9, 585.1, 533.3, 585.3, 239/585.4, 585.5; 251/129.06, 127.07, 129.16, 251/129.18, 129.19

See application file for complete search history.

(56) References Cited

U.S. PATENT DOCUMENTS 5,114,077 A * 5/1992 Cerny ..... 239/483
5,299,776 A 4/1994 Brinn, Jr. et al.
5,901,941 A 5/1999 Ricco
6,279,873 B1 8/2001 Eichendorf et al.
6,367,769 B1 * 4/2002 Reiter ..... 251/129.19
6,474,572 B1 11/2002 Tsuchiya et al.
6,619,269 B1 9/2003 Stier et al.
6,783,086 B1 8/2004 Boecking (Continued)

FOREIGN PATENT DOCUMENTS

DE 19756103 A1 6/1999

(Continued)

OTHER PUBLICATIONS

Chinese Office Action issued May 9, 2008.

(Continued)

*Primary Examiner*—Darren W Gorman
(74) *Attorney, Agent, or Firm*—Crowell & Moring LLP

(57) ABSTRACT

An injector used for an internal combustion engine includes a valve needle which closes a fuel passage by contacting a valve seat and opens the fuel passage by separating from the valve seat. A coil and a magnetic core are provided to drive the valve needle, and an anchor is held in a relatively displaceable state with respect to the valve needle. A first biasing device biases the valve needle in a direction opposite to a direction of a drive force, and a second biasing device biases the anchor in the direction of the drive force with a set load smaller than that of the first biasing device. A restricting feature restricts relative displacement of the anchor with respect to the valve needle in the direction of the drive force.

16 Claims, 9 Drawing Sheets

U.S. PATENT DOCUMENTS

| | | | | |
|---|---|---|---|---|
| 6,799,734 | B1 * | 10/2004 | Hans | 239/585.1 |
| 7,163,162 | B2 | 1/2007 | Tsuchiya et al. | |
| 2004/0041039 | A1 | 3/2004 | Hofmann | |
| 2006/0226252 | A1 | 10/2006 | Kubo et al. | |
| 2007/0075166 | A1 | 4/2007 | Tsuchiya et al. | |

FOREIGN PATENT DOCUMENTS

| | | | |
|---|---|---|---|
| DE | 19849210 | A1 | 4/2000 |
| DE | 19927900 | A1 | 12/2000 |
| JP | 6-4368 | U | 1/1994 |
| JP | 2002-506502 | A | 2/2002 |
| JP | 2003-21014 | A | 1/2003 |
| JP | 2005-69233 | A | 3/2005 |
| JP | 2005-195015 | A | 7/2005 |
| JP | 2006-57641 | A | 3/2006 |
| JP | 2006-77775 | A | 3/2006 |
| JP | 2006-77776 | A | 3/2006 |
| WO | WO 00/25018 | A1 | 5/2000 |
| WO | 2004074673 | A1 | 9/2004 |
| WO | WO 2004109092 | A1 * | 12/2004 |

OTHER PUBLICATIONS

European Search Report mailed Mar. 4, 2009.
Japanese Office Action dated Aug. 18, 2009 (Three (3) pages).
Japanese Office Action with partial English translation dated Jan. 26, 2010 (Six (6) pages).
European Search Report mailed May 12, 2010.

* cited by examiner

ELECTRO-MAGNETO FUEL INJECTOR

BACKGROUND OF THE INVENTION

1. Field of the invention

The present invention relates to an electro-magneto fuel injector used for an internal combustion engine, which injector generates magnetic flux in a magnetic circuit including an anchor and a core by passing an electric current through a coil to cause a magnetic attraction force for attracting the anchor to the core side, thereby opening and closing a valve needle.

2. Description of Related Art

JP-A-2003-21014 discloses a fuel injector in which an anchor and a valve needle are fixed by using a buffer material to cushion impact which occurs when a stopper surface and the anchor collide with each other. In this fuel injector, the anchor and the valve needle are connected by frictional connection.

JP-A-2005-195015 discloses a fuel injector in which an anchor and a valve needle are connected by frictional connection and by shape connection, and an auxiliary process spring is used between the anchor and the valve needle to prevent an improper opening (valve opening) operation.

BRIEF SUMMARY OF THE INVENTION

In both of the fuel injectors disclosed in JP-A-2003-21014 and JP-A-2005-195015, the anchor and the valve needle are connected by frictional connection. By the frictional connection of the anchor and the valve needle, the valve needle can be restrained from bounding by colliding with the body side of the fuel injector when the valve needle is operated to open and close. However, by reviewing the connection relationship of the anchor and the valve needle, it becomes possible to enhance response of the valve needle and to control injection quantity of fuel more precisely.

An object of the present invention is to provide a fuel injector enhanced in responsiveness of a valve needle and capable of precisely controlling injection quantity.

In order to attain the above-described object, an electromagnetic fuel injector of the present invention includes:

a valve needle which closes a fuel passage by being contacted on a valve seat, and opens the fuel passage by separating from the valve seat;

an electromagnet which is provided as a drive means of the valve needle, and has a coil and a magnetic core;

an anchor which is held by the valve needle in a relatively displaceable state with respect to the valve needle in a drive direction of the valve needle;

a first biasing means which biases the valve needle in a direction opposite to a direction of a drive force by the drive means;

a second biasing means which biases the anchor in the direction of the drive force with a set load smaller than a set load of the first biasing means; and a restricting means which restricts relative displacement of the anchor with respect to the valve needle in the direction of the drive force.

In this case, preferably, the first biasing means and the second biasing means are both constituted by springs, the spring which constitutes the first biasing means has one end supported at one location of a housing which contains the valve needle and the other end contacting the valve needle, and the spring which constitutes the second biasing means has one end supported at another location of the housing and the other end contacted on the anchor.

Further in this case, preferably, the spring which constitutes the first biasing means has the one end supported at the one location of the housing so as to contact a spring retainer provided inside the housing to adjust a set load of this spring, and the spring which constitutes the second biasing means has the one end supported at the other location of the housing so as to contact the spring seat fixed to the housing.

Further, the spring seat is preferably formed in a guide member which guides the valve needle in its drive direction.

Preferably, the restricting means is configured as contact surfaces of the anchor and the valve needle which face each other, and the contact surface constructed on the anchor is contacted on the contact surface constructed on the valve needle only by the set load by the second biasing means.

Further, when the anchor receives the drive force in a state where it is contacted on the valve seat and remains stationary, the contact surface constructed on the anchor may be contacted on the contact surface constructed on the valve needle before the anchor starts to move.

Movement of the valve needle in a direction away from the valve seat is preferably restricted only by the first biasing means.

The valve needle may be pressed against the valve seat by a set load obtained by subtracting the set load of the second biasing means from the set load of the first biasing means, and when it is driven by the electromagnet, it may be driven against the set load obtained by subtracting the set load of the second biasing means from the set load of the first biasing means.

According to the present invention, when the anchor is in a state where it remains stationary while being contacted on the valve seat, it is held in a state where it is displaced to the position where the relative displacement in the direction of the drive force with respect to the valve needle is restricted by the second biasing means and the restricting means. Accordingly, when the anchor receives the drive force in a state where it remains stationary while being contacted on the valve seat, the anchor can move the valve needle in the valve opening direction without delaying from the time of starting its movement. Thereby, the fuel injector capable of enhancing responsiveness of the valve needle and precisely controlling the injection quantity can be provided.

Other objects, features and advantages of the invention will become apparent from the following description of the embodiments of the invention taken in conjunction with the accompanying drawings.

DETAILED DESCRIPTION OF THE INVENTION

Hereinafter, embodiments will be described.

Embodiment 1

Figure 1:
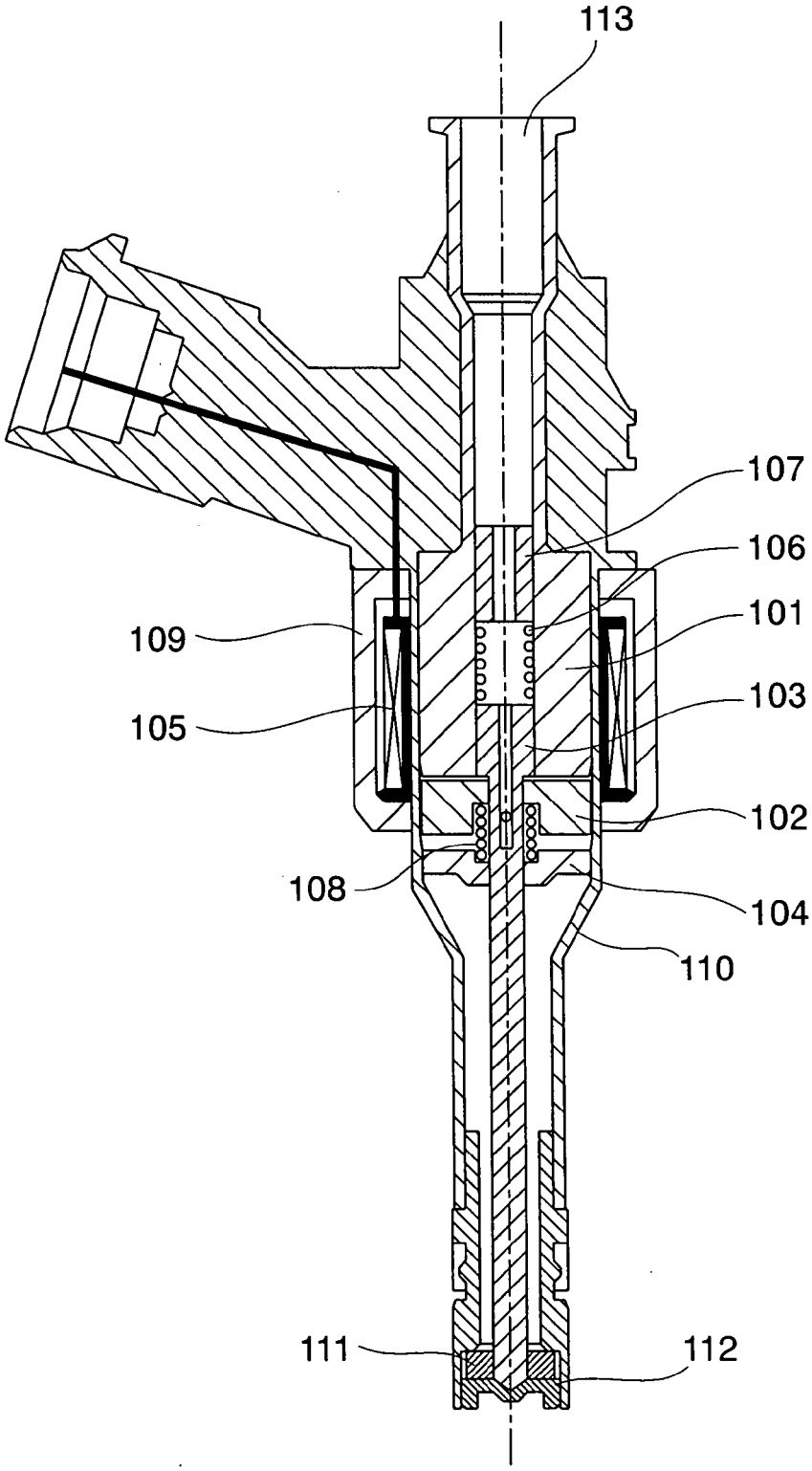
FIG. 1 is a sectional view showing an embodiment of a fuel injector according to the present invention.
Figure 2:
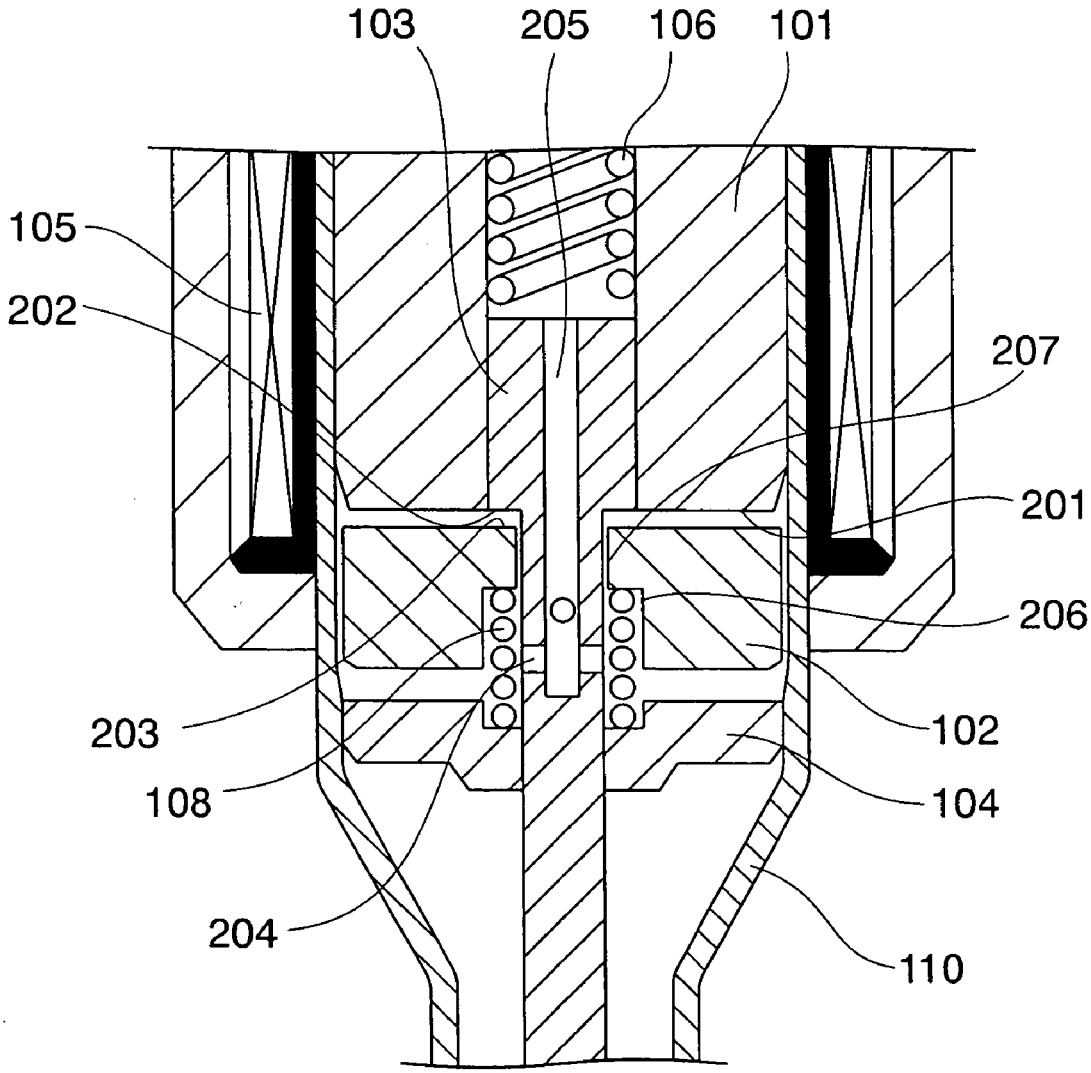
FIG. 2 is an enlarged sectional view of the vicinity of a collision part of an anchor and a valve needle of a fuel injector according to a first embodiment of the present invention.

FIG. 1 is a sectional view of a fuel injector according to the present invention, and FIG. 2 is an enlarged view of the vicinity of a magnetic core 101 generating a magnetic attraction force and an anchor 102. The fuel injector shown in FIGS. 1 and 2 is a normally closed type electromagnetic valve (electro-magneto fuel injector), and when a coil 105 is not energized, a valve needle 103 is closely contacted with a nozzle 112 by a biasing spring 106, and the valve is in a closed state. In this valve closed state, the anchor 102 is closely contacted with the valve needle side 103 by a position adjust spring 108, so that a gap exists between the anchor 102 and the magnetic core 101. A rod guide 104 which guides a rod is fixed to a housing 110 which contains the valve needle 103, and this rod guide 104 constitutes a spring seat of the position adjust spring 108. The force by the biasing spring 106 is adjusted by the pressing amount of a spring retainer 107 fixed to an inside diameter of the core 101 at the time of assembly.

The coil 105 and the magnetic core (or just called as a core) 101 constitute an electromagnet as a drive means of the valve needle 103. The biasing spring 106 operating as a first biasing means biases the valve needle 103 in an opposite direction to a direction of the drive force by the drive means. The position adjust spring 108 operating as a second biasing means biases the anchor 102 in the direction of the drive force with a set load smaller than a set load by the biasing spring 106.

When passing the current through the coil 105, magnetic flux is generated in a magnetic circuit constructed by the core 101, the anchor 102 and a yoke 109, and the magnetic flux passes through a gap between the anchor 102 and the core 101. As a result, a magnetic attraction force acts on the anchor 102, and when the generated magnetic attraction force exceeds the force by the biasing spring 106, the anchor 102 is displaced to a side of the core 101. When the anchor 102 is displaced, the force is transmitted between a collision surface 203 on the anchor side and a collision surface 202 on the valve needle side, and the valve needle 103 is also displaced at the same time, so that the valve needle is in the open state.

When the current passing through the coil 105 is stopped in the valve close state, the magnetic flux passing through the magnetic circuit decreases, and the magnetic attraction force which acts between the anchor 102 and the core 101 reduces. At that time, the force by the biasing spring 106 which acts on the valve needle 103 is transmitted to the anchor 102 through the collision surface 202 on the anchor side and the collision surface 203 on the valve needle side. Therefore, when the force by the biasing spring 106 exceeds the magnetic attraction force, the anchor 102 and the valve needle 103 are displaced in the valve closing direction, so that the valve is in the closed state.

As shown in FIGS. 1 and 2, the valve needle 103 is formed into a rod shape having a step to form the collision surface (which is also called as a contact surface) 202 on the valve needle side, and the anchor 102 is provided with a hole smaller than the outermost diameter of the valve needle 103 in its center, so that the collision surface (which is also called the contact surface) 203 on the anchor side is formed. As a result, a force is transmitted between the collision surface 202 on the valve needle side and the collision surface 203 on the anchor side, and therefore, even when the anchor 102 and the valve needle 103 are given as separate individual components, the basic opening and closing operations of the electromagnetic valve can be performed. The collision surfaces 202 and 203 become restricting means which restricts relative displacement in the direction of the drive force of the anchor 102 with respect to the valve needle 103.

The contact surface 203 on the anchor 102 side is contacted on the contact surface 202 on the valve needle 103 side only by the set load by the position adjust spring 108. When the anchor 102 receives a drive force in the state where it is contacted on the valve seat and remains stationary, the contact surface 203 on the anchor 102 side is contacted on the contact surface 202 on the valve needle 103 side before it starts to move. At this time, the valve needle 103 is not especially provided with a stopper for movement in a direction away from the valve seat, and therefore further movement of the valve needle 103 is restricted when the biasing spring 106 is in a fully contracted state. Namely, the movement in the direction away from the valve seat is restricted only by the biasing spring 106.

Since the anchor needs to be a magnetic substance, it is sometimes difficult to use a hard material for it. Thus, in order to secure durability, it is desirable to apply hard plating such as chrome plating and electroless nickel plating to the collision surface 203 on the anchor side.

Since the valve needle 103 and the anchor 102 are provided as separate components in this manner, and further, the outermost diameter of the valve needle 103 is made smaller than a fuel passage (corresponding to a center hole of the core in FIG. 1) in a portion of a passage from a fuel inlet port 113 of the fuel injector to the anchor 102 except the biasing spring 106 and the spring retainer 107, the valve needle can be inserted after the fuel injector is assembled. Meanwhile, the valve needle is provided with fuel passage holes 204 and 205.

Figure 3:
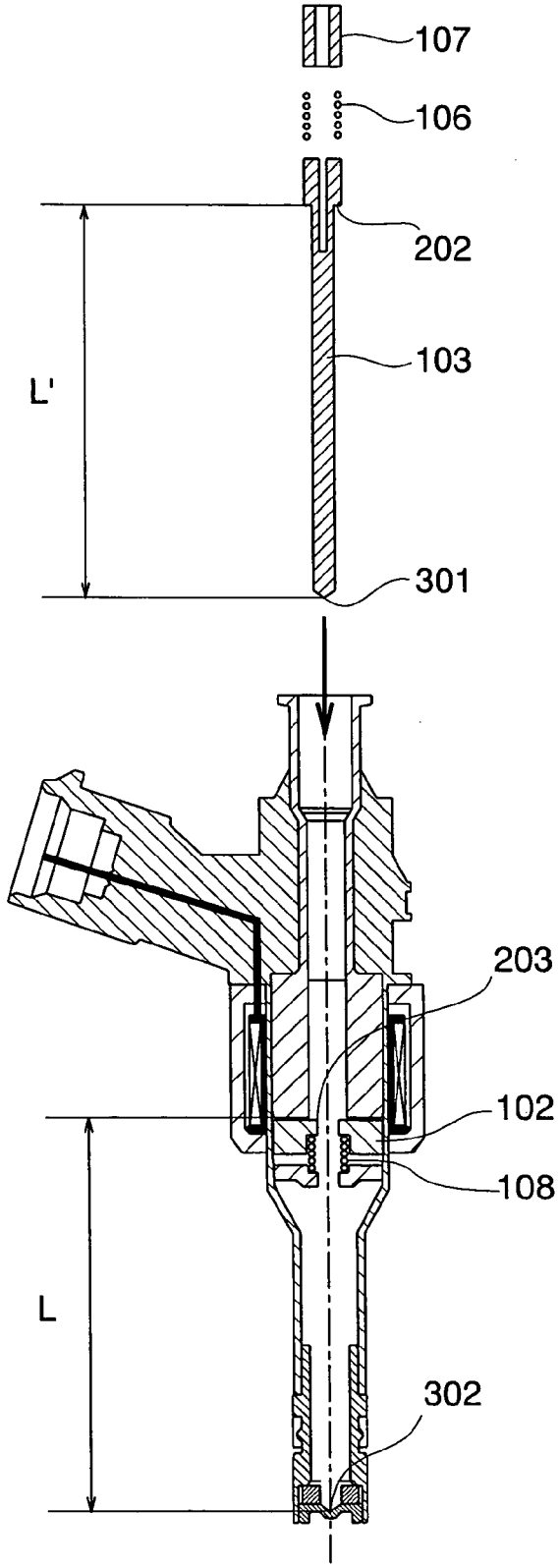
FIG. 3 is a view showing an assembly process of the fuel injector according to the first embodiment of the present invention.

FIG. 3 is a view showing that assembly is possible by inserting the valve needle 103 after the core 101, the housing 110, the yoke 109, the coil 105, the rod guide 104 and the anchor 102 are assembled.

For the fuel injector, press-fitting and welding are frequently performed in the assembling process for the purpose of preventing leakage of a fuel, securing a flux passage area of members constituting the magnetic circuit, and keeping the structural strength. For example, in the example in FIG. 1, the assembly is performed by using the welding between the yoke 109 and the housing 110, and the press-fitting and the welding between the core 101 and the housing 110. In this case, by the force applied at the time of press-fitting, and thermal deformation occurring at the time of welding, a subtle error may be caused in the relative positional relationship, and in geometrical shapes and dimensions of the core 101, the housing 110, the yoke 109, the coil 105 and the rod guide 104. In the prior art, since the welding and the press-fitting are required to be performed after incorporating the valve needle 103 as well as the above components and the anchor 102, the stroke is sometimes changed at the time of assembly due to deformation caused by the welding and the press-fitting as described above. In the prior art, since stroke adjustment cannot be performed after assembly, it is sometimes difficult to control the stroke precisely.

In the fuel injector according to the present invention, the valve needle can be inserted after the welding and the press-fitting in the assembly process of the fuel injector are performed as shown in FIG. 3. As a result, based on the measurement result of the dimensions of the fuel injector after assembly, the valve needle in such a size that makes it possible to obtain a desired stroke can be selected and assembled to adjust the stroke.

In the structure shown in FIG. 3, the stroke is determined by the difference between a distance L' between the collision surface 202 on the valve needle side and a seat part 301 which is at the tip end of the valve needle 103 and is to be in contact with the valve seat, and a distance L between the collision end surface 203 of the anchor 102 pressed against the end surface of the core 101 and a seat part 302 on the valve seat side which is to be in contact with the valve needle.

Accordingly, in the assembling process, the L is measured in advance, and the valve needle 103 which is in the relation of L'=L−St where St is a desired stroke is inserted, whereby the stroke of the fuel injector can be adjusted to a desired value. As a concrete method of measuring the value of L, a valve needle for measurement, or a pin in the shape imitating the valve needle, of which value corresponding to L' is already known, is inserted into the fuel injector in advance, the position where it is in contact with the anchor is detected, and the moving distance from this position to the position where the valve needle comes in contact with the seat part 301 is measured. Alternatively, after the valve needle for measurement of which value corresponding to L' is known is inserted in advance, the valve needle is kept in contact with the seat part 301 by a spring or the like, and the valve needle for measurement is actually operated by energizing the coil, whereby the moving distance of the valve needle at the time of operation is measured. From the difference between the moving distance obtained here and a desired stroke, the length of L' of the valve needle 103 to be inserted is determined. The stroke can be determined in the post process in this manner, and therefore, the stroke can be precisely adjusted. Since the stroke can be precisely adjusted, controllability of the injection quantity is enhanced, and productivity of the fuel injector is enhanced, thereby making it possible to reduce cost.

Since the assembling process as described above is adopted, it is desirable that the outside diameter of the position adjust spring 108 is determined such that even if the position adjust spring 108 moves in the radial direction within a recess 206 provided in the anchor 102, the wire of the position adjust spring 108 does not enter a slide hole 207 provided in the anchor 102. Since the wire of the position adjust spring 108 does not enter the slide hole 207, a trouble caused by interference of the position adjust spring with the valve needle can be prevented at the time of insertion of the valve needle.

Figure 4A:
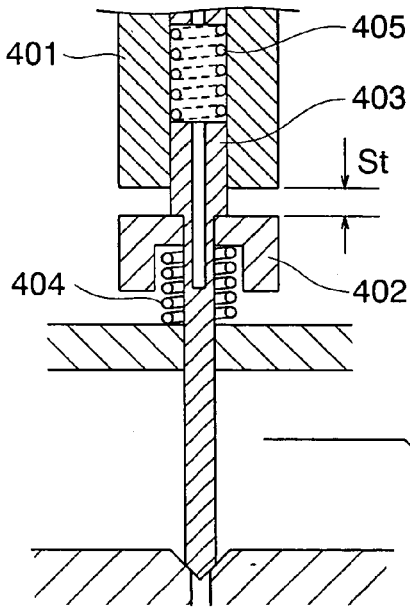
FIGS. 4A to 4D are schematic views showing states of motion of the anchor and the valve needle at the time of opening the valve of the fuel injector according to the first embodiment of the present invention.
Figure 4B:
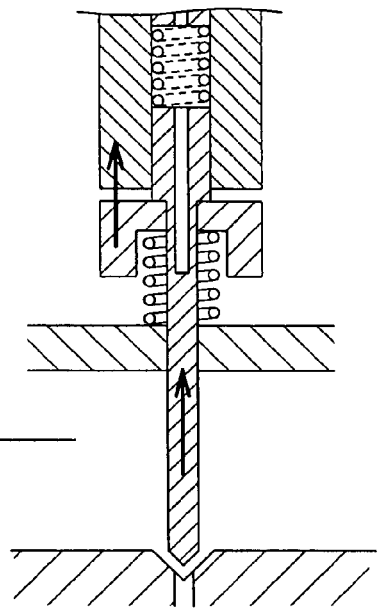
Figure 4C:
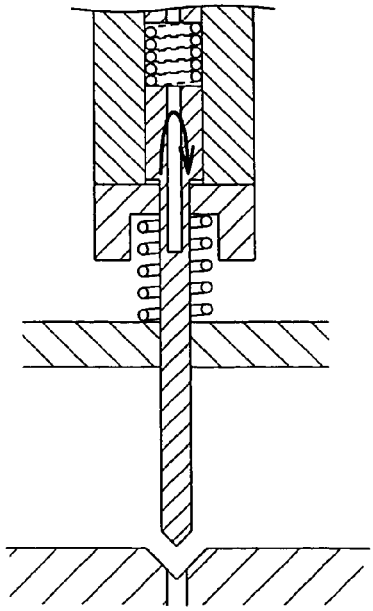
Figure 4D:
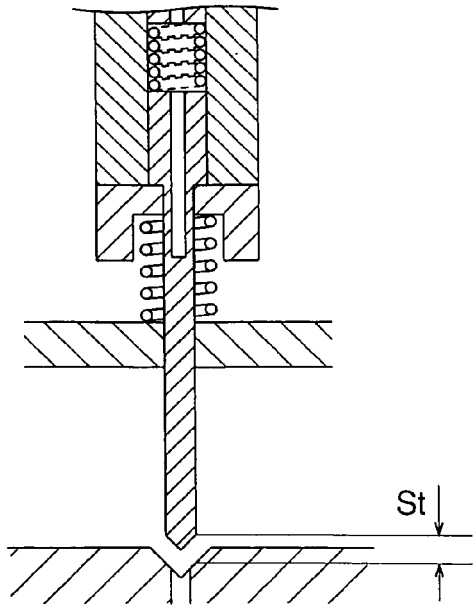

FIGS. 4A-4D are schematic views showing valve opening motion of the valve needle 103 and the anchor 102 of the fuel injector according to the present invention. FIGS. 4A-4D are views illustrated as schematic views, and the valve needle 103 is illustrated as a valve needle 403, while the anchor 102 is illustrated as an anchor 402. The valve needle 403 which is biased by a biasing spring 405 in advance is pressed against the valve seat, and the valve is in the closed state (FIG. 4A). When a magnetic attraction force occurs between the core 401 and the anchor 402 and surpasses the force by the biasing spring 405, the anchor 402 and the valve needle 403 start to move (FIG. 4B). When the anchor 402 collides with the core 401, it cannot move upward any more, but the valve needle 403 can continue to move further upward here (FIG. 4C). At this time, the anchor 402 bounds in a space from the core 401 and sometimes lacks in stability. However, in the structure according to the present invention, the anchor 402 and the valve needle 403 are separated, and therefore, when the anchor 402 bounds, the spring force by the biasing spring 405 does not act on the anchor 402. Accordingly, while the anchor 402 bounds, only the magnetic attraction force acts on the anchor 402, the anchor 402 is easily and stably in close contact with the core 401, and unstable bound of the anchor 402 is suppressed. As a result, it becomes possible to provide the fuel injector in which the fine control of the injection quantity is easy. Since the valve needle 403 is separated from the anchor 402, the mass of it can be made smaller as compared with the case where the valve needle and the anchor are connected. Therefore, the valve needle 403 which temporarily moves more than the stroke can quickly return to the stroke position by the force by the biasing spring 405, and thus, control characteristics of the injection quantity is not adversely affected (FIG. 4C).

Figure 5A:
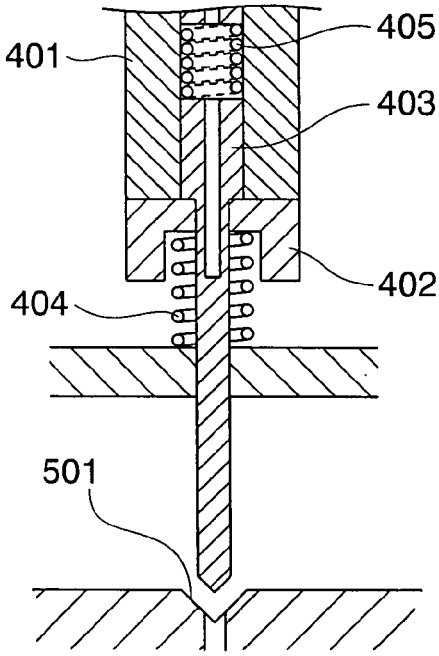
FIGS. 5A to 5D are schematic views showing states of motion of the anchor and the valve needle at the time of closing the valve of the fuel injector according to the first embodiment of the present invention.
Figure 5B:
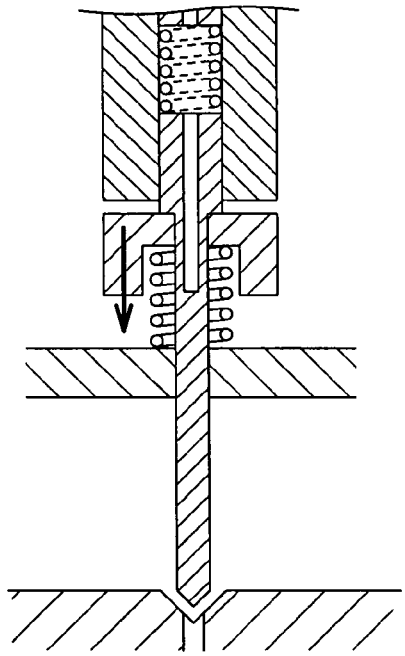

FIGS. 5A-5D are schematic views of valve closing motion of the valve needle 103 and the anchor 102 of the fuel injector according to the present invention. FIG. 5A is a view showing the state of the valve in the open state. The anchor 402 is raised by an electromagnetic force acting between the core 401 and the anchor 402. When an electric current to the coil is turned off, and the magnetic force acting between the core 401 and the anchor 402 becomes small, the valve needle 403 receives a force by the biasing spring 405, and starts operation in the valve closing direction together with the anchor 402 (FIG. 5B).

Figure 5C:
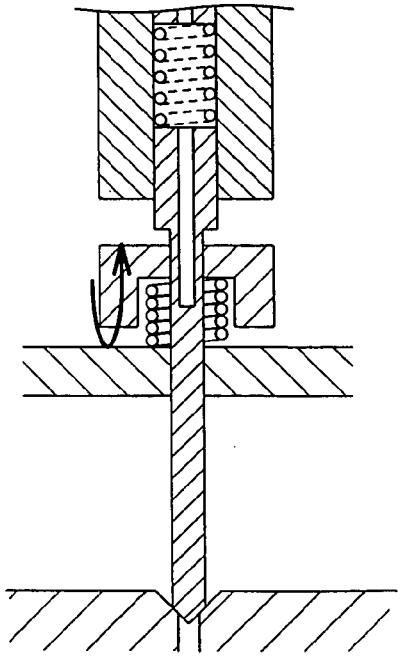

When the valve needle 403 further continues to move, the valve needle 403 soon collides with a seat part 501 as shown in FIG. 5C. Since the valve needle 403 separates from the anchor 402, and the valve needle 403 is smaller in diameter than the anchor 402 in this case, the weight of the valve needle 403 can be significantly reduced as compared with the case where the valve needle and the anchor are integrated. Therefore, when the valve needle 403 collides with the seat part 501 and bounces back, kinetic energy which the valve needle 403 has immediately before the collision can be suppressed to be small, and the natural period of the spring-mass system formed by the biasing spring 405 and the valve needle 403 can be made short, as a result of which, the bound period and height can be suppressed to be small.

Figure 5D:
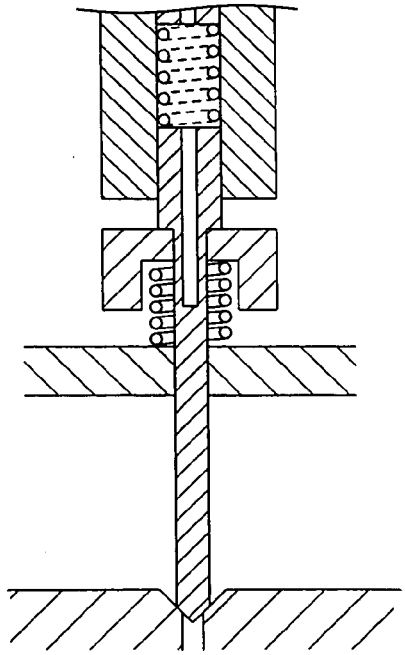

In this case, there is nothing that restrains the movement of the anchor 402 even after the movement of the valve needle 403 stops and the valve is in the closed state, and therefore, the anchor 402 continues to move. At this time, the anchor 402 moves while forming the spring-mass system with a retaining spring 404. When the spring constant of the retaining spring 404 is sufficiently small as compared with the spring constant of the biasing spring 405, the moving distance of the anchor 402 can be made larger than the stroke of the valve needle 403. Since the anchor 402 receives resistance by a fuel and releases the kinetic energy while moving, the released kinetic energy becomes large if the moving range of the anchor 402 is large, and when the anchor 402 returns to the position as shown in FIG. 5D, it cannot open the valve needle 403 again or if it can open the valve needle 403, the effect can be restricted to be very small. As a result, secondary injection in which the fuel is injected by the bound after the valve closing can be suppressed.

As described above, in the fuel injector according to the present invention, the anchor is connected to the body of the fuel injector via the position adjust spring, and the anchor and the valve needle transmit a force to each other only by a single collision surface. Therefore, at the time of the valve opening, the anchor and the valve needle move independently, without exerting a force on each other, immediately after the core 401 and the anchor 402 collide with each other as shown in FIG. 4C. Therefore, the anchor 402 receives only the magnetic attraction force without receiving the force of the spring 405, and therefore, it is quickly stabilized and attracted by the core 401, while the valve needle 403 moves independently from the anchor 402 and therefore, forms the spring-mass system with light mass and can be stabilized in a short time. Since the anchor 402 and the valve needle 403 independently move at the time of the valve closing, the valve needle 403 does not receive the reaction force of the moving anchor 402, and therefore, the valve needle 403 can move as the substance with light mass, which contributes to suppression of bound.

Figure 6:
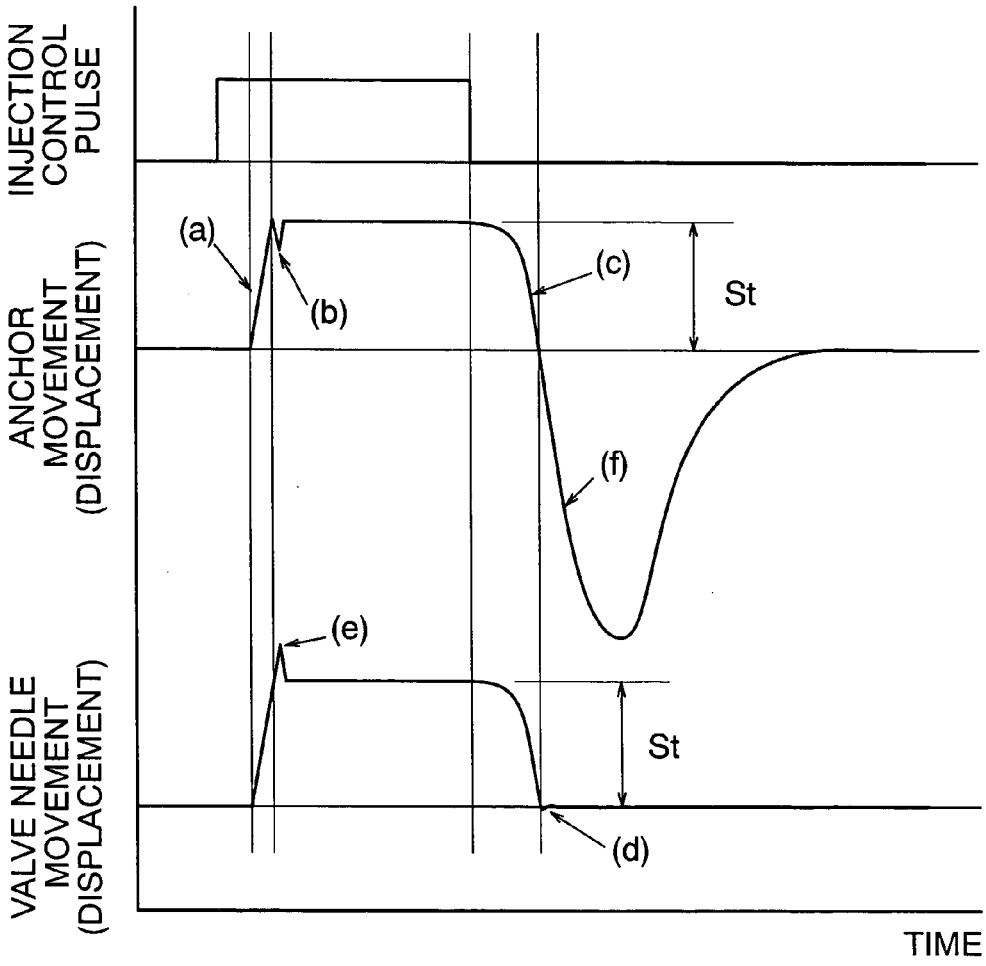
FIG. 6 is a time chart showing an opening and closing valve operation of the fuel injector according to the first embodiment of the present invention.

FIG. 6 shows such a series of movements in a time chart form. The anchor and the valve needle start to move as shown in FIG. 6A with a little delay time with respect to the injection control pulse, and when the anchor reaches a predetermined stroke St, the anchor bounds by the core as indicated by (b) in FIG. 6. At this time, the valve needle overshoots as indicated by (e) in FIG. 6, but it returns to the stroke position in a short time. When the injection control pulse terminates, and the valve needle starts to move in the valve closing direction, the valve needle and the anchor simultaneously displace in the valve closing direction as indicated by (c) in FIG. 6. When the valve needle displaces by a predetermined stroke, it stops its displacement by contact with the seat part as indicated by (d) in FIG. 6. The bound amount of the valve needle at this time is very small because the valve needle is light. The anchor continues to displace even after the valve needle stops moving as indicated by (f) in FIG. 6, and since the spring constant of the retaining spring is small, the displace amount of the anchor becomes large. Therefore, the kinetic energy released during this time can be made large, and the movement of the valve needle is not adversely affected when the anchor returns to the position of the valve needle.

According to the embodiment as described above, the stroke of the fuel injector can be precisely adjusted, and the stable operation of the valve needle is possible at the valve opening time since the valve needle is light. Thus, the bound is suppressed at the time of valve opening, thereby making it possible to suppress the secondary injection. As a result, control of the injection quantity can be performed more precisely, and the controllable range of the injection quantity can be expanded.

Embodiment 2

Figure 7:
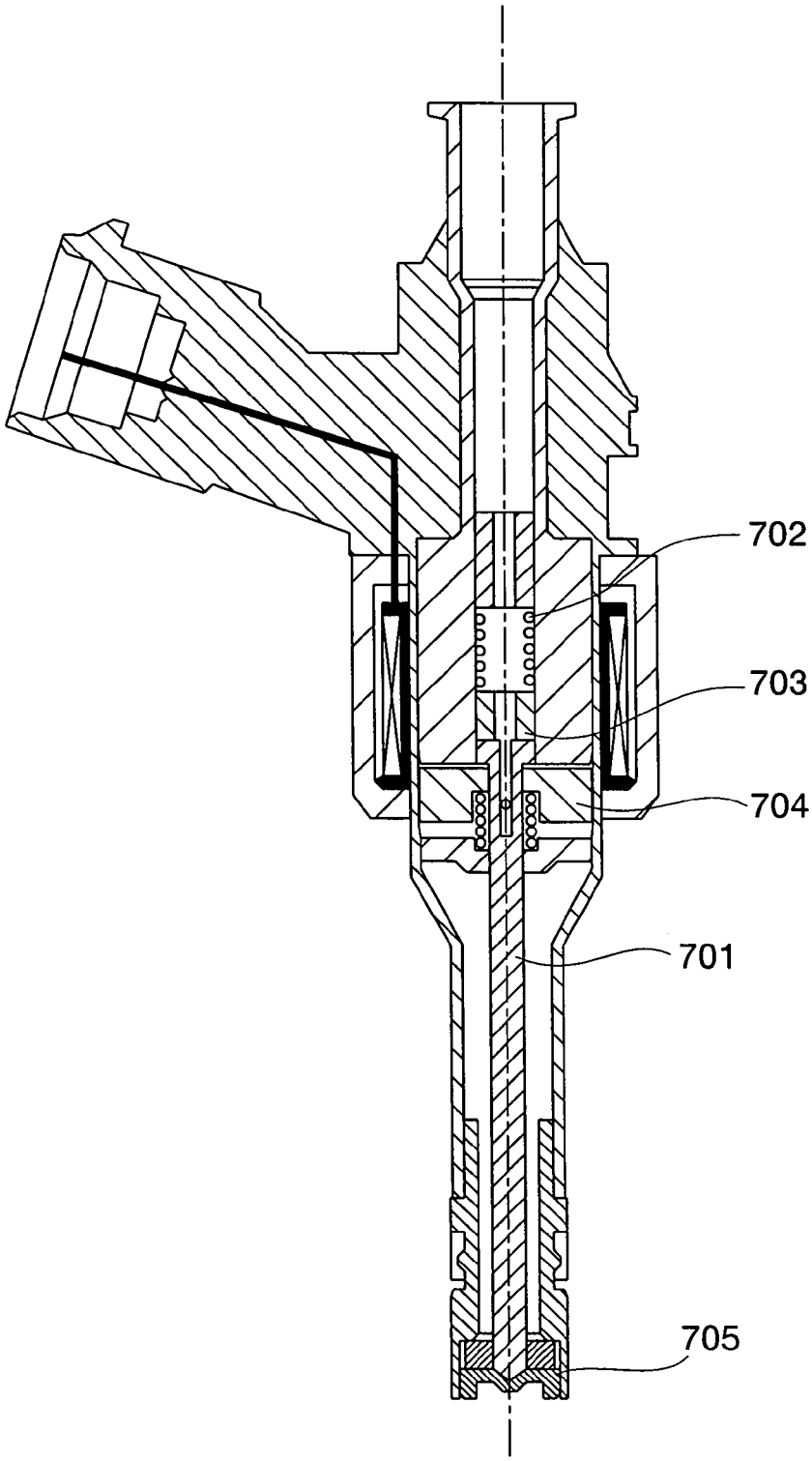
FIG. 7 is a sectional view of a fuel injector according to a second embodiment of the present invention.

FIG. 7 is a sectional view of a fuel injector provided with a pipe-shaped member 703 between a valve needle 701 and a spring 702 in addition to the fuel injector according to the present invention shown in Embodiment 1.

By being provided with the pipe-shaped member 703 between the spring 702 and the valve needle 701, the bound amount of the valve needle 702 at the time of the valve opening can be made smaller. When the valve needle 701 collides with a seat member 705 at the time of the valve opening, the valve needle 701 generates compression stress and slightly contracts, and stores the kinetic energy as strain energy. The stored strain energy is released at the next moment, and the valve needle 701 bounds as the result of extension of the contracted valve needle 701. At this time, since it is provided with the pipe-shaped member 703, the pipe-shaped member 703 has the kinetic energy at the time of the valve closing, and thus it is possible to obtain the effect of pressing down the valve needle 701, which is to bound in the valve closing direction, by an inertia force. In the fuel injector according to the present invention, the valve needle 701 and the anchor 704 are separate structures which are not connected to each other, and therefore, the mass of the valve needle 701 can be made small. Therefore, the strain energy stored by the valve needle 701 at the time of bound is small, and the effect of the pipe-shaped member 703 can be sufficiently exhibited.

As a result of this, the bound amount of the valve needle 701 can be made further smaller than the case shown in Embodiment 1, and therefore, the fuel injector with less secondary injection can be provided as the fuel injector.

Embodiment 3

Figure 8:
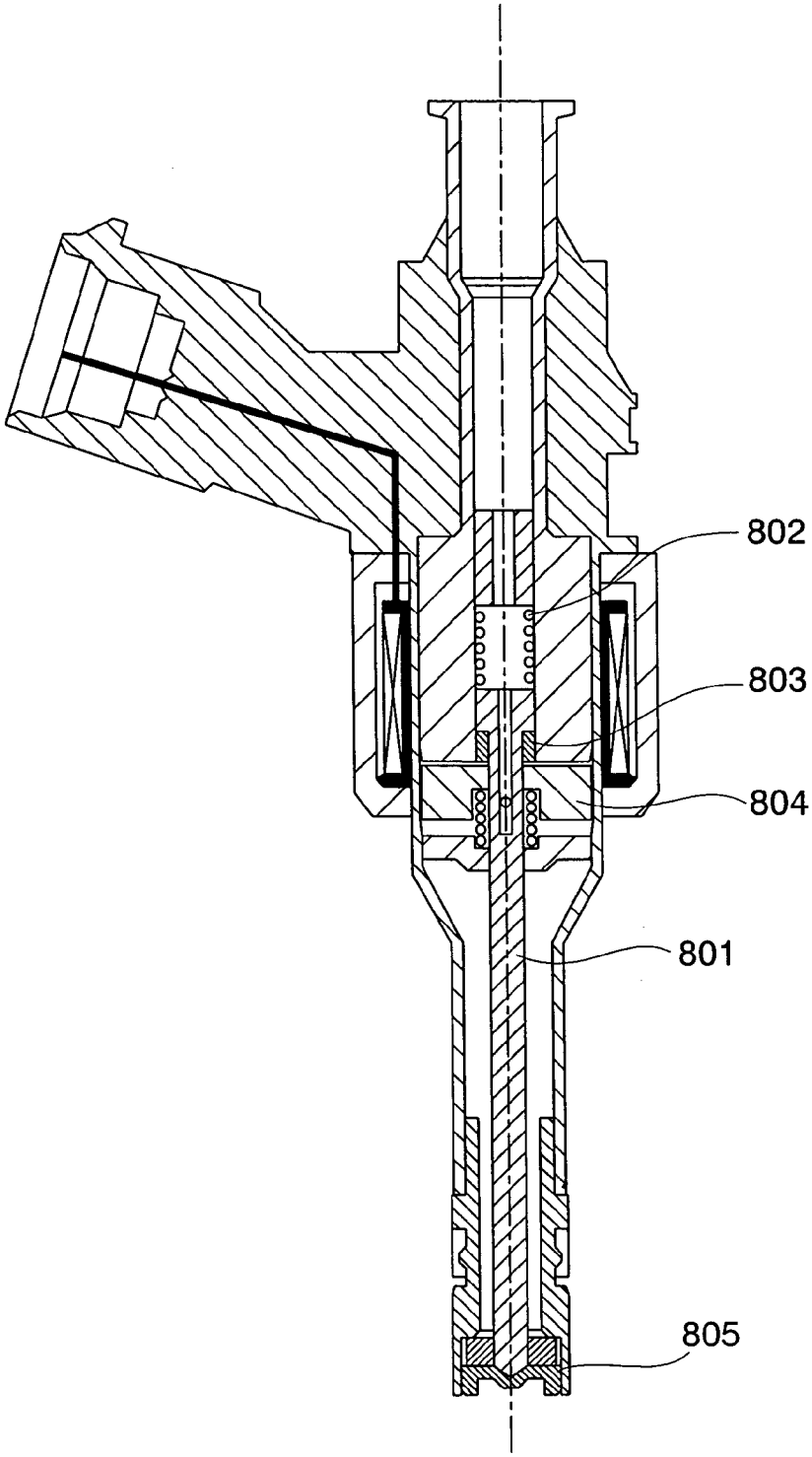
FIG. 8 is a sectional view of a fuel injector according to a third embodiment of the present invention.

FIG. 8 is a sectional view of a furl injector provided with a member 803 capable of individually moving from a valve needle 801 between the valve needle 801 and the anchor 804 in addition to the fuel injector according to the present invention shown in Embodiment 1.

In the fuel injector shown in Embodiment 1, it is possible to perform the stroke adjustment after assembly of the fuel injector, and the adjustment is made by adjusting the length of the valve needle. However, the valve needle has a relatively large length among the components of the fuel injector, and therefore, it may be difficult to adjust its length precisely. Since the valve needle has not only the function of determining the stroke, but also the function of keeping sealing performance with the seat part, or its smoothness of movement per se has the function of keeping control precision of the fuel injector. Therefore, the valve needle is the component requiring relatively high machining precision. Accordingly, preparation of a number of highly precise machine-worked components for stroke adjustment is not always advantageous in cost. The stroke is controlled by the length of the valve needle from the seat part to the collision surface, but there may be difficulty in controlling the length from the seat part by strictly grasping it, and it is sometimes difficult to perform the stroke control only by the length of the valve needle.

In such a case, it is effective to provide the member 803 capable of moving individually from the valve needle 801 between the valve needle 801 and the anchor 804. By providing the member 803 separate from the valve needle 801 which requires precise machine work, adjustment of the stroke can be performed by the thickness of the member 803. As a result, the members which have to be prepared in large quantities for adjustment of the stroke can be replaced only by the relatively small member 803, and the adjustment of the stroke can be controlled by the thickness of the member 803. Thus, the stroke control easier than the case shown in Embodiment 1 can be realized.

Embodiment 4

Figure 9:
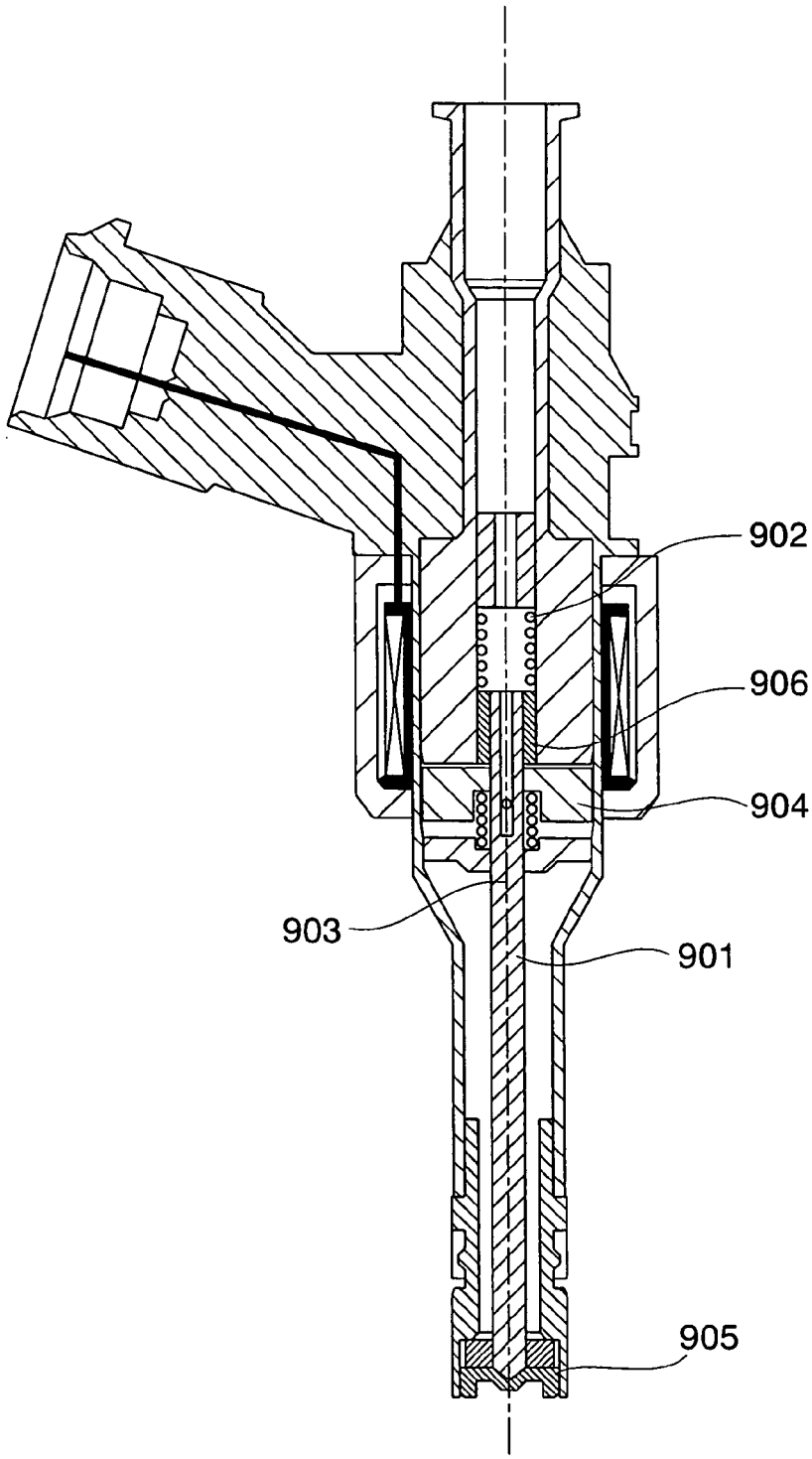
FIG. 9 is a sectional view of a fuel injector according to a fourth embodiment of the present invention.

FIG. 9 is a sectional view showing an example in which a part forming a contact surface of a valve needle and an anchor 904 is constituted by a separate member 906 which is non-magnetic or has weak magnetism, in addition to the fuel injector according to the present invention shown in Embodiment 1.

A valve needle 903 needs to secure sealing performance for a fuel by contacting with the seat part, and also needs to resist abrasion by repeated collision with the seat part, and therefore, it is desired to be a relatively hard material. When martensitic stainless steel or the like is used for the valve needle 903 for example, a favorable characteristic can be obtained in the viewpoint of abrasion resistance. However, when a magnetic material such as martensitic stainless steel is used for the valve needle, in the case of the valve needle having the shape as shown in Embodiment 1, the magnetic flux leaks from the core via the valve needle, and reduction in magnetic flux density on the attraction surface is caused to reduce magnetic attraction force. When reduction in magnetic attraction force by this effect is not desired, it is preferable that the uppermost end of the valve needle is positioned on the downstream side from the attraction surface of the core, or the non-magnetic separate member 906 is used as shown in FIG. 9. Since a part of the valve needle located at the upstream side from the anchor 904 becomes the route of leakage of magnetic flux, leakage of the magnetic flux is reduced by making this part nonmagnetic, and reduction in the magnetic attraction force can be suppressed.

By using such a separate member, the stroke can be adjusted by the positional relationship of the separate member 906 and the valve needle 902, and the effect like that of Embodiment 3 can be obtained.

The problems to be solved by the fuel injectors according to the above described respective embodiments will be described hereinafter.

The fuel injector opens and closes the fuel passage by separation and contact between the valve needle and the valve seat, and controls the injection quantity in accordance with the length of time during which the fuel passage opens. At this time, the displace amount of the valve needle (stroke) is defined by the collision surface which restrains the movement of the valve needle by colliding with the valve needle or the anchor connected to the valve needle. Namely, the dimension of a gap formed between the collision surface on the valve needle side in the case that the valve needle is in the closed state, and the collision surface on the fuel injector body side determines the stroke.

The magnitude of the stroke influences the motion of the valve needle and the fluid resistance at the time of fuel injection. For example, in the fuel injector which causes the valve needle to open and close by the electromagnetic force, the attraction force by a magnetic force operates the valve needle. On this occasion, the dimension of the gap at the initial time influences the magnetic attraction force, and therefore, if adjustment of the stroke varies, the timing in which the valve needle starts operation, and the magnitude of the force at the time of start vary. As a result, the time length during which the valve needle is in the open state varies.

Therefore, if precise adjustment of the stroke is difficult, there are the method of adopting in advance the design value such that the injection quantity hardly changes with respect to the stroke amount, and the method of adjusting the injection quantity in a final process so as to absorb the variation of the stroke. However, the design when such methods are adopted does not always provide a conditions to perform the best valve needle operation for the fuel injector. Namely, the controllable range of the injection quantity of the fuel injector is limited, and responsiveness of the fuel injector and the injection quantity controllability sometimes do not become sufficient especially in a very small injection quantity. Accordingly, in order to control the injection quantity precisely, it is desirable that the stroke is precisely adjusted to be a value which is designed in advance.

However, the fuel injector requires press-fitting and welding in the assembling process for the purpose of preventing fuel leakage or the like and ensuring strength. If a large force such as press-fitting is applied, or thermal deformation is caused by the welding in the assembling process, the relative positional relationship of the components constituting the fuel injector may be deformed slightly. If the position of the above described collision surface on the fuel injector side changes at this time, the stroke changes, and it becomes difficult to adjust the stroke precisely. In this case, it is difficult to control the injection quantity precisely.

Meanwhile, when the valve needle of the fuel injector performs an opening and closing operations, and when the valve needle collides with the fuel injector body side, the valve needle sometimes bounds. The bound deteriorates controllability of the injection quantity, and causes secondary injection in which a very small quantity of excess fuel is injected after valve closing.

The bound of the valve needle can be prevented by using a buffering material and incorporating an auxiliary process spring in the valve needle, but the assembling process is complicated, and it becomes difficult to make precise adjustment of the stroke and bound suppression at the time of the opening and closing operation of the valve needle compatible with each other. Therefore, difficulty may sometimes accompany realization of precise injection quantity characteristic and suppression of the secondary injection.

In the structure of each of the above described embodiments, the electromagnetic fuel injector is provided with a valve needle 103 which closes a fuel passage by being contacted on a valve seat and opens the fuel passage by separating from the valve seat, an electromagnet which is provided as a drive means of the valve needle 103 and has a coil 105 and a magnetic core 101, an anchor 102 which is held by the valve needle 103 in a state of being relatively displaceable in a drive direction of the valve needle 103 with respect to the valve needle 103, a first biasing means (biasing spring) 106 which biases the valve needle 103 in a direction opposite to a direction of a drive force by the drive means 105 and 101, a second biasing means (position adjust spring) 108 which biases the anchor 102 in the direction of the drive force with a set load smaller than that by the first biasing means 106, and a restricting means (collision surfaces) 202, 203 which restricts relative displacement of the anchor 102 in the direction of the drive force with respect to the valve needle 103.

The first biasing means 106 and the second biasing means 108 are both constituted by springs, the spring which constitutes the first biasing means 106 has one end supported at one location of a housing 110 which contains the valve needle 103 and the other end contacting the valve needle 103, and the spring which constitutes the second biasing means 108 has one end supported at another location of the housing 110 and the other end contacted on the anchor 102.

The spring which constitutes the first biasing means 106 has the one end supported at the one location of the housing 110 so as to contact a spring retainer 107 provided inside the housing 110 to adjust a set load of this spring, and the spring which constitutes the second biasing means 108 has the one end supported at the other location of the housing 110 so as to contact the spring seat fixed to the housing 110.

The spring seat is formed at a guide member 104 which guides the valve needle 103 in its drive direction.

The restricting means 202, 203 is configured as contact surfaces of the anchor 102 and the valve needle 103 which face each other, the contact surface 203 constructed on the anchor 102 is contacted on the contact surface 202 constructed on the valve needle 103 only by the set load by the second biasing means 108.

When the anchor 102 receives the drive force in a state where it remains stationary while being contacted on the valve seat, the contact surface 203 constructed on the anchor 102 is contacted on the contact surface 202 constructed on the valve needle 103 before the anchor starts to move.

The movement of the valve needle 103 in a direction away from the valve seat is restricted only by the first biasing means 106.

In the normally closed type fuel injector having a fuel injection hole, a valve seat placed near the fuel injection hole, the valve needle 103 opening and closing the fuel passage by contacting with and separating from the valve seat, and the anchor 102 which generates a force at the time of valve opening and displaces the valve needle 103, wherein the valve needle 103 is pressed against the valve seat with the force by the spring 106, and wherein the anchor 102 and the valve needle 103 are configured to be slidable with respect to each other, the valve needle 103 and the anchor 102 have contact surfaces which allow the anchor 102 to generate a reaction force against the force in the direction in which the valve needle 103 closes, and transmission of the forces in between the valve needle 103 and the anchor 102 the opening and closing directions is performed only by the contact surfaces 202 and 203.

In the prior art, the anchor and the valve needle are joined to form one component. On the contrary, the present invention adopts the structure in which the valve needle and the anchor are made as separate components which are not connected to each other, and the transmission of the forces is performed by the contact surfaces of the respective ones.

By constructing the valve needle and the anchor which are given as separate components so that transmission of forces can be performed by one contact surface, it becomes possible to insert the valve needle in the last process of assembly, and it becomes possible to adjust a stroke without being influenced by precision of press-fitting and deformation by welding. As a result, it is possible to adjust the stroke of the fuel injector precisely, and the injection quantity can be controlled precisely.

Since the valve needle and the anchor are separated as separate components, the weight of the valve needle can be decreased, and response at the time of opening and closing the valve can be enhanced. Since the anchor which is provided as a separate component can move separately from the valve needle at the time of valve closing, collision energy occurring at the time of valve closing is only kinetic energy of the valve needle having less weight, and thus can be made small, the kinetic energy of the anchor can be released into the fuel separately from the valve needle, and second injection can be prevented.

When the anchor is in the state where it is contacted on the valve seat and remains stationary, it is held in the state where it is displaced to the position in which the relative displacement in the direction of the drive force with respect to the valve needle is restricted by the second biasing means and the restricting means. Accordingly, when the anchor receives the drive force from the state where it is contacted on the valve seat and remains stationary, the anchor can move the valve needle in the valve opening direction without delaying from the time of starting its movement. Thereby, the fuel injector capable of enhancing responsiveness of the valve needle and precisely controlling the injection quantity can be provided.

When the drive force acts on the anchor by the electromagnet, a biasing force by the second biasing means operates to assist the drive force. Meanwhile, when the drive force is shut off and the valve needle returns to the position where it is contacted on the valve seat by the first biasing means, the set load by the second biasing means serves to weaken the set load by the first biasing means. Accordingly, when the valve closing operation needs to be hastened, the set load by the first biasing means is adjusted to be stronger as compared with the case including no second biasing means.

According to the fuel injector of each of the embodiments according to the present invention, precise adjustment of the stroke, and suppression of the bound of the valve needle can be made compatible, precise injection quantity characteristic is realized, and secondary injection can be suppressed.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An electromagnetic fuel injector, comprising:

a valve member in which a seat part provided on a tip end thereof contacts a valve seat to close a fuel passage, and separates from the valve seat to open the fuel passage;

an electromagnet provided as a drive for the valve member, and having a coil and a magnetic core;

an anchor held by the valve member in a state of being relatively displaceable with respect to the valve member in a drive direction of the valve member;

a housing which accommodates the anchor, the magnetic core being fixed on an inner peripheral side of the housing, the coil being fixed on an outer peripheral side of the housing;

a first spring which biases the valve member in a direction opposite to a direction of a drive force by the drive;

a second spring which biases the anchor in the direction of the drive force with a biasing load smaller than a biasing load of the first spring; and a restrictor configured to restrict relative displacement of the anchor with respect to the valve member in an axial direction of the valve member, the restrictor being arranged between only a side of the anchor facing the magnetic core and the valve member so as to allow the valve member to move independently relative to the anchor in the direction of the drive force, wherein the second spring is arranged between a spring seat provided in the housing to which the magnetic core and the coil are fixed so that the second spring and the anchor are located between the spring seat and the magnetic core within the housing.

2. The electromagnetic fuel injector according to claim 1, wherein in the first spring includes the one end which contacts a spring retainer provided in an inner diameter portion of the magnetic core for adjusting a set load of the first spring and another end which contacts the valve member, and the second spring has includes one end which contacts the spring seat fixed to the housing and another end which contacts the anchor.

3. The electromagnetic fuel injector according to claim 1, wherein the spring seat is formed in a guide member which guides the valve member in its drive direction.

4. The electromagnetic fuel injector according to claim 1, wherein when the anchor receives the drive force in a state where the valve member remains stationary while contacting the valve seat, a first contact surface constructed on the anchor contacts a second contact surface constructed on the valve member before the anchor starts moving.

5. The electromagnetic fuel injector according to claim 1, wherein movement of the valve member in a direction away from the valve seat is restricted only by the first spring.

6. The electromagnetic fuel injector according to claim 1, wherein the valve member is pressed against the valve seat by a biasing load obtained by subtracting the biasing load of the second spring from the biasing load of the first spring, and the valve member is driven by the electromagnet, against the biasing load obtained by subtracting the biasing load of the second spring from the biasing load of the first spring.

7. The electromagnetic fuel injector according to claim 1, wherein the anchor is configured so as to be relatively displaceable toward a valve seat side without being restricted by the valve member in a state where the seat part provided in the valve member contacts the valve seat, and the valve member is configured so as to be relatively displaceable toward the drive force with respect to the anchor without being restricted by the anchor in a state where the movement of the anchor toward the drive force is restricted.

8. The electromagnetic fuel injector according to claim 7, wherein the anchor is configured so that the movement toward the drive force is restricted by contacting the magnetic core.

9. The electromagnetic fuel injector according to claim 1, wherein the second spring and the anchor are inserted into in the housing from a magnetic core side, arranged in order from the spring seat side and installed in the housing, and then the magnetic core is installed in the housing.

10. The electromagnetic fuel injector according to claim 1, wherein the valve member is pressed against the valve seat by a biasing load obtained by subtracting the biasing load of the second spring from the biasing load of the first spring, and the biasing load obtained by subtracting the biasing load of the second spring from the biasing load of the first spring that presses the valve member against the valve seat is adjusted by adjusting the biasing load of the first spring.

11. An electromagnetic fuel injector, comprising:

a valve member in which a seat part is provided on a tip end thereof;

a valve seat which the seat part contacts at the time of valve closing, and from which the seat part separates at the time of valve opening;

an electromagnet having a coil and a magnetic core for driving the valve member;

an anchor which is displaceable relative to the valve member in an axial direction of the valve member;

a first spring which biases the valve member in a valve closing direction;

a second spring which biases the anchor in a valve opening direction with a biasing load smaller than a biasing load of the first spring, and a housing wherein the magnetic core is fixed on an inner peripheral side of the housing, and the coil is fixed on an outer peripheral side of the housing, wherein the valve member comprises a restrictor located at one side with respect to the anchor so as to restrict relative displacement of the anchor toward the valve opening direction, and wherein the second spring is arranged between a spring seat provided in the housing to which the magnetic core and the coil are fixed so that the second spring and the anchor are located between the spring seat and the magnetic core within the housing, wherein the valve member is configured so as to be relatively displaceable in the valve opening direction with respect to the anchor without being restricted by the anchor when the valve member moves to the valve opening state from the valve closing state.

12. The electromagnetic fuel injector according to claim 11, wherein the anchor is configured so that the movement of the anchor toward the valve opening direction is restricted by contacting the magnetic core.

13. The electromagnetic fuel injector according to claim 11, wherein the second spring includes one end which contacts a spring seat member fixed to the housing and another end which contacts the anchor, and the first spring includes one end which contacts a spring retainer provided in an inner diameter portion of the magnetic core for adjusting the biasing load of the first spring and another end which contacts the valve member.

14. The electromagnetic fuel injector according to claim 13, wherein a guide part is formed in the spring seat member of the second spring for guiding the valve member in its drive direction, so that the spring seat member of the second spring also works as a guide member.

15. The electromagnetic fuel injector according to claim 11, wherein the second spring and the anchor are inserted into the housing from a magnetic core side, arranged in order from the spring seat side and installed in the housing, and then the magnetic core is installed in the housing.

16. The electromagnetic fuel injector according to claim 11, wherein the valve member is pressed against the valve seat by a biasing load obtained by subtracting the biasing load of the second spring from the biasing load of the first spring, and the biasing load obtained by subtracting the biasing load of the second spring from the biasing load of the first spring that presses the valve member against the valve seat is adjusted by adjusting the biasing load of the first spring.

* * * * *